US007671267B2

(12) United States Patent
Hillborg

(10) Patent No.: US 7,671,267 B2
(45) Date of Patent: Mar. 2, 2010

(54) MELODY GENERATOR

(76) Inventor: Mats Hillborg, Strandvägen 29 C, SE-191 35, Sollentuna (SE)

( * ) Notice: Subject to any disclaimer, the term of this patent is extended or adjusted under 35 U.S.C. 154(b) by 18 days.

(21) Appl. No.: 12/278,055

(22) PCT Filed: Jan. 12, 2007

(86) PCT No.: PCT/SE2007/000018

§ 371 (c)(1),
(2), (4) Date: Aug. 1, 2008

(87) PCT Pub. No.: WO2007/091938

PCT Pub. Date: Aug. 16, 2007

(65) Prior Publication Data

US 2009/0025540 A1 Jan. 29, 2009

(30) Foreign Application Priority Data

Feb. 6, 2006 (SE) ..... 0600243

(51) Int. Cl.
*G10H 1/00* (2006.01)

(52) U.S. Cl. ..... 84/609; 84/649

(58) Field of Classification Search ..... 84/609, 84/649

See application file for complete search history.

(56) References Cited

U.S. PATENT DOCUMENTS 4,399,731 A * 8/1983 Aoki ..... 84/609
4,926,737 A * 5/1990 Minamitaka ..... 84/611
4,982,643 A * 1/1991 Minamitaka ..... 84/613
5,003,860 A * 4/1991 Minamitaka ..... 84/609
5,099,740 A * 3/1992 Minamitaka ..... 84/651
5,218,153 A * 6/1993 Minamitaka ..... 84/613
5,375,501 A * 12/1994 Okuda ..... 84/611
5,425,297 A * 6/1995 Young, Jr. ..... 84/483.2
5,451,709 A * 9/1995 Minamitaka ..... 84/609
5,486,647 A * 1/1996 Kay et al. ..... 84/635
5,496,962 A * 3/1996 Meier et al. ..... 84/601
5,627,335 A * 5/1997 Rigopulos et al. ..... 84/635
5,679,913 A * 10/1997 Bruti et al. ..... 84/609

(Continued)

FOREIGN PATENT DOCUMENTS

EP 1274069 A2 1/2003

(Continued)

OTHER PUBLICATIONS

International Search Report corresponding to PCT/SE2007/000018, mailing date of May 10, 2007.

(Continued)

*Primary Examiner*—David S. Warren
(74) *Attorney, Agent, or Firm*—Renner, Otto, Boisselle & Sklar, LLP

(57) ABSTRACT

The invention relates to a method for automatic generation of melodies where from one step to a following a new parameter value is generated that is sent to a unit emitting sound. The parameters comprise a new note pitch, a new window width, a life span for the window width, a window offset and a life span for the window offset. The new note pitch is selected according to a given probability distribution within the interval of note pitches given by the note pitch in a previous step, the window width and the window offset.

3 Claims, 1 Drawing Sheet

U.S. PATENT DOCUMENTS

| | | | | |
|---|---|---|---|---|
| 5,705,761 | A * | 1/1998 | Minamitaka | 84/609 |
| 5,736,663 | A * | 4/1998 | Aoki et al. | 84/609 |
| 5,990,407 | A * | 11/1999 | Gannon | 84/613 |
| 6,051,770 | A * | 4/2000 | Milburn et al. | 84/611 |
| 6,075,193 | A * | 6/2000 | Aoki et al. | 84/609 |
| 6,103,964 | A * | 8/2000 | Kay | 84/611 |
| 6,121,532 | A * | 9/2000 | Kay | 84/611 |
| 6,124,543 | A * | 9/2000 | Aoki | 84/609 |
| 6,143,971 | A * | 11/2000 | Aoki et al. | 84/609 |
| 6,226,606 | B1 * | 5/2001 | Acero et al. | 704/218 |
| 6,252,152 | B1 * | 6/2001 | Aoki et al. | 84/609 |
| 6,297,439 | B1 | 10/2001 | Browne | |
| 6,384,310 | B2 * | 5/2002 | Aoki et al. | 84/609 |
| 6,392,134 | B2 * | 5/2002 | Aoki | 84/609 |
| 6,472,591 | B2 * | 10/2002 | Aoki et al. | 84/611 |
| 6,506,969 | B1 * | 1/2003 | Baron | 84/609 |
| 6,541,691 | B2 * | 4/2003 | Tolonen et al. | 84/616 |
| 6,576,828 | B2 * | 6/2003 | Aoki et al. | 84/635 |
| 6,608,249 | B2 * | 8/2003 | Georges | 84/609 |
| 6,639,141 | B2 * | 10/2003 | Kay | 84/609 |
| 6,740,802 | B1 * | 5/2004 | Browne, Jr. | 84/609 |
| 6,746,246 | B2 * | 6/2004 | Cliff | 434/219 |
| 6,756,533 | B2 * | 6/2004 | Aoki | 84/609 |
| 6,791,021 | B2 * | 9/2004 | Aoki | 84/613 |
| 6,822,153 | B2 * | 11/2004 | Comair et al. | 84/609 |
| 6,984,781 | B2 * | 1/2006 | Mazzoni | 84/613 |
| 7,053,291 | B1 * | 5/2006 | Villa | 84/609 |
| 7,102,069 | B2 * | 9/2006 | Georges | 84/609 |
| 7,169,996 | B2 * | 1/2007 | Georges et al. | 84/609 |
| 7,169,997 | B2 * | 1/2007 | Kay | 84/611 |
| 7,183,478 | B1 * | 2/2007 | Swearingen | 84/609 |
| 7,319,185 | B1 * | 1/2008 | Wieder | 84/609 |
| 7,335,834 | B2 * | 2/2008 | Gayama | 84/613 |
| 7,342,166 | B2 * | 3/2008 | Kay | 84/609 |
| RE40,543 | E * | 10/2008 | Aoki et al. | 84/609 |
| 7,491,878 | B2 * | 2/2009 | Orr | 84/609 |
| 7,498,504 | B2 * | 3/2009 | Bourgeois | 84/609 |
| 2002/0000156 | A1 * | 1/2002 | Nishimoto et al. | 84/609 |
| 2002/0002897 | A1 * | 1/2002 | Pachet et al. | 84/609 |
| 2002/0007720 | A1 * | 1/2002 | Aoki et al. | 84/609 |
| 2002/0011145 | A1 * | 1/2002 | Aoki | 84/609 |
| 2002/0117045 | A1 * | 8/2002 | Mita et al. | 84/609 |
| 2002/0134219 | A1 * | 9/2002 | Aoki | 84/609 |
| 2003/0188625 | A1 * | 10/2003 | Tucmandl | 84/609 |
| 2004/0089136 | A1 * | 5/2004 | Georges et al. | 84/609 |
| 2004/0089138 | A1 * | 5/2004 | Georges et al. | 84/609 |
| 2004/0159213 | A1 * | 8/2004 | Eruera | 84/609 |
| 2006/0086235 | A1 * | 4/2006 | Mizuno | 84/609 |
| 2007/0186752 | A1 * | 8/2007 | Georges et al. | 84/609 |
| 2007/0221044 | A1 * | 9/2007 | Orr | 84/609 |
| 2008/0053293 | A1 * | 3/2008 | Georges et al. | 84/609 |
| 2008/0156176 | A1 * | 7/2008 | Edlund | 84/609 |
| 2009/0064851 | A1 * | 3/2009 | Morris et al. | 84/637 |

FOREIGN PATENT DOCUMENTS

| | | | |
|---|---|---|---|
| GB | 2378306 | A | 2/2003 |
| JP | 05181408 | A | 7/1993 |

OTHER PUBLICATIONS

International Search Report On Patentability corresponding to PCT/SE2007/000018, date of completion of Feb. 2, 2008.

* cited by examiner

MELODY GENERATOR

The present invention relates to a melody generator according to the preamble of the independent claims.

BACKGROUND

Methods and devices that automatically generates melodies are described in literature and are, for example, used in mobile phones for ringtones, in toys and in digital musical instruments. Distinguishing for these, is that they do not generate melodies that are perceived as appealing enough to be used to a great extent, and companies in a need of generating melodies are forced to pay fees to musicians and composers.

One known such method for melody generation is described in *Machine Musicianship* (Robert Rowe) p. 208-209, where tones are generated randomly within a so-called tendency mask, i.e. an interval of pitches. However, the described method is quite simplistic and only creates melodies with a very modest degree of enjoyableness.

In the same book, p. 305-306, is also described a slightly more complex variety of the above method, where successive pitches are selected according to the statistics of Brownian Movement, though still with the requirement that they are positioned within a given interval. This method doesn't create melodies of any higher degree of enjoyableness either.

Hence, one purpose of the invention is to provide a melody generator, and a method for such a melody generator that creates melodies that are perceived as more appealing than those that are created with known technology for melody generators.

These, and other purposes are reached through a melody generator according to the characterising parts of the independent claims.

SUMMARY OF THE INVENTION

The invention relates to a method and a device for automatic generation of melodies, comprising a series of successive steps, and a device capable of executing these steps. Each step corresponds to the smallest note duration value used by the melody generator. From one step to a following, one or more new parameter values are generated, and these are designated to be sent to a unit emitting sound according to these parameter values representing e.g. note pitch, or to be saved in e.g. a MIDI file. The parameters may include a new note pitch, a window width, a life span for the window width, a window offset and a life span for the window offset, where the new note pitch is selected according to a given probability distribution within the interval of note pitches given by the note pitch in a previous step, the window width and the window offset.

SHORT DESCRIPTION OF THE FIGURES

DESCRIPTION OF A PREFERRED EMBODIMENT

Figure 1:
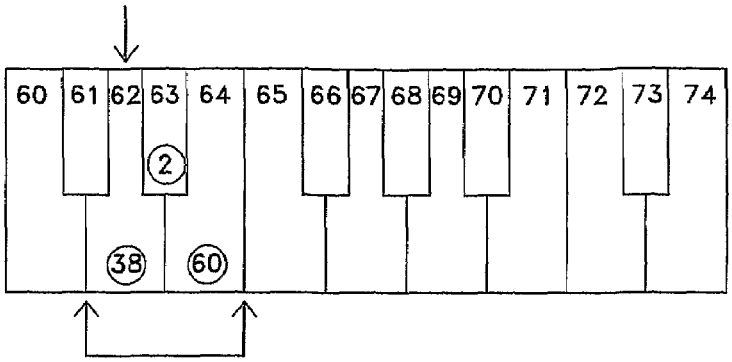
FIG. 1 shows a first step in a melody generation method according to the invention.
Figure 2:
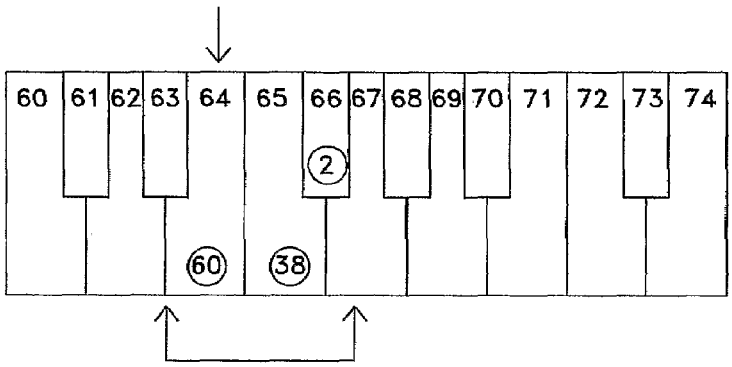
FIG. 2 shows a second step in the melody generation method.

The melody generator generates a series of note values relating to note pitch, note duration and other parameters used for creating a melody. The selection of note values is made in successive steps, where each step corresponds to the shortest note duration value used by the generator. In the preferred embodiment, selections are made by random choice from a table of possible values according to a probability distribution decided by assigning each value a specific probability.

The values of all the parameters used by the melody generator may be changed at any time during the creation of a melody, as may also the tables of probability distributions for the values. To achieve this, a life span parameter is created as soon as a parameter is allotted a new value. This life span value decides the number of forthcoming steps that the new parameter value will be valid. When the life span of the parameter has run out, a new parameter value and new life span is selected.

To generate the pitch of the notes, the melody generator is initialized by selecting a starting pitch within a predefined interval corresponding to the available pitch interval of a given instrument. If the MIDI standard is used, which is common in the context, each pitch position is described as an integer, and with this way of defining note pitch, the available pitch interval for piano could be e.g. 24-84. Furthermore, the parameters window width, window offset and the life span of these parameters are initialized by selecting values for them. These values may be selected among e.g. the values 3, 5, 7, 9, respectively −4, −2 −1, 0, 1, 2 or 4 respectively 1, 2, 3, 4, 5, 6, 7.

For each new step in the generation of a melody, an interval of selectable pitches is calculated using the parameters window width and window offset, so that all the selectable pitches are within an interval that is as wide, expressed in e.g. MIDI pitch positions, as is indicated by the window width and centered around the pitch of the previous note plus the parameter value window offset. Another way of expressing this is stating that all the selectable pitches are between the pitch of the previous note+window offset−½ window width and the pitch of the previous note+window offset+½ window width This means that if the parameter value window offset is zero, the previous note pitch is placed in the middle of the interval of selectable pitches, while with a positive or negative window offset value, the interval is placed asymmetrically relative to the previous note pitch and the interval may not include this.

Pitches within this interval are assigned a probability value between zero and 100% in such a way that the combined probability for all the pitches is 100% after appropriate weighting. How these probabilities are distributed is ruled by the musical style desired for the generated melody.

When the available pitches have been calculated and each pitch within the interval has been assigned a probability, a pitch is selected with a probability corresponding to its assigned probability value. The note with the selected pitch is sent to a suitable instrument that can generate an actual tone, typically a digital, MIDI controlled, musical instrument. Subsequently, the described cycle is begun anew.

FIGS. 1-4 show the actual procedure for an imagined realisation of four successive steps during generation of a melody according to the described method.

Initially, before step 1, illustrated in FIG. 1, a note with an initial pitch of 62 has been selected and the arrow above key 62 indicates that this is the pitch selected before the current step. Furthermore, a window width of three has been selected and a value of three has been selected for the life span parameter of the window width. The window offset initially selected is one, and the life span for the window offset is two.

Below the keys is shown the possible interval within which a new pitch can be selected, and here it is stretching from pitch 62 to pitch 64 (both inclusive), which gives an interval of possible pitches of three, i.e. corresponding to the initially set value of the window width. The mean value of the available pitches is one pitch step higher than the previous pitch, i.e. in accordance with the parameter value for the window offset being just one.

On the keys possible to select according to the window width and window offset, probability values are indicated within circles. A random generator is used, and here selects a next pitch of 64, which will be indicated with an arrow above the keys in FIG. 2. None of the window width or window offset parameters are changed since their life spans have not expired in this step, but a new pitch of 65 is selected.

Figure 3:
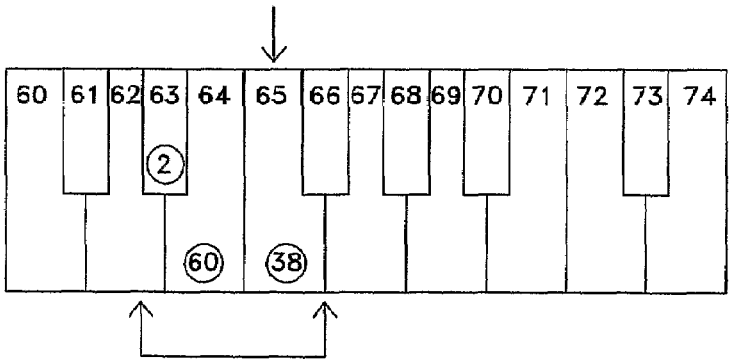
FIG. 3 shows a third step in the melody generation method.

In FIG. 3 the previous pitch is shown above the keys, but since the life span of the window offset has expired, a new window offset and corresponding new life span is selected from a table of possible window offsets and corresponding life spans, with different probability distributions. In this imagined case, the result is a new window offset value of minus one, and the mean value of the interval of possible pitches relative to the previous note pitch will be just minus one. The new life span of this window offset is set to one. Within the interval given by the window parameters a new pitch of 64 is selected in the same way as in the previous steps.

Figure 4:
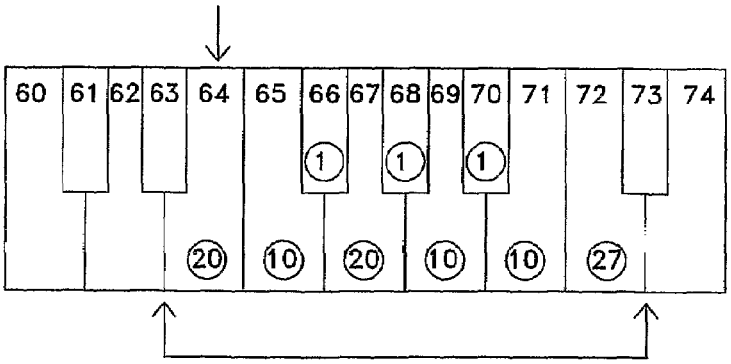
FIG. 4 shows a fourth step in the melody generation method.

In FIG. 4, illustrating a fourth step, the life span of both the window width and the window offset has expired, and new values of nine and four are selected for these as above, in accordance with the possible interval of pitches indicated by the arrows below the keys. A new pitch is selected, as are new life spans for window width and window offset, respectively.

The invention claimed is:

1. A method for automatic generation of melodies comprising a series of successive steps where from one step to a following at least one new parameter value is generated that is arranged to be sent to a unit emitting sound in accordance with at least one of these parameter values, where the parameters at least comprise a note pitch, a pitch window width and a pitch window offset, and where the new note pitch is selected according to a given probability distribution given by the note pitch of a previous step and the current pitch window width and pitch window offset, wherein the new pitch window widths and pitch window offsets are generated according to given probability distributions.

2. A method for automatic generation of melodies according to claim 1, wherein the parameters further comprise a life span for the pitch window width.

3. A method for automatic generation of melodies according to claim 2, wherein the parameters further comprise a life span for the pitch window offset.

* * * * *